US006715655B1

(12) United States Patent
Taylor et al.

(10) Patent No.: US 6,715,655 B1
(45) Date of Patent: Apr. 6, 2004

(54) COMBUSTION CHAMBER LOCK-OUT MECHANISM

(75) Inventors: Walter J. Taylor, McHenry, IL (US); Yury Shkolnikov, Glenview, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 10/336,461

(22) Filed: Jan. 3, 2003

(51) Int. Cl.[7] ..... B25C 1/04

(52) U.S. Cl. ..... 227/8; 227/10; 227/130

(58) Field of Search ..... 227/8, 10, 130; 123/46 SC

(56) References Cited

U.S. PATENT DOCUMENTS

| | | | | | |
|---|---|---|---|---|---|
| 3,964,659 | A | * | 6/1976 | Eiben et al. | 227/8 |
| 4,483,473 | A | * | 11/1984 | Wagdy | 227/8 |
| 4,483,474 | A | | 11/1984 | Nikolich | |
| 4,629,106 | A | * | 12/1986 | Howard et al. | 227/8 |
| 5,197,646 | A | * | 3/1993 | Nikolich | 227/8 |
| 5,485,946 | A | * | 1/1996 | Jankel | 227/8 |
| 5,671,880 | A | * | 9/1997 | Ronconi | 227/130 |
| 5,687,897 | A | * | 11/1997 | Fa et al. | 227/8 |
| 5,909,836 | A | | 6/1999 | Shkolnikov et al. | |
| 6,145,724 | A | | 11/2000 | Shkolnikov et al. | |
| 6,223,963 | B1 | * | 5/2001 | Aparacio, Jr. | 227/8 |

* cited by examiner

*Primary Examiner*—Scott A. Smith
(74) *Attorney, Agent, or Firm*—Lisa M. Soltis; Mark W. Croll; Donald J. Breh

(57) ABSTRACT

A lock-out mechanism, for use in conjunction with a combustion-powered fastener-driving tool, is operatively engaged with the tool trigger mechanism so as to be movable between extended and retracted positions. The lock-out mechanism is adapted to engage a wear plate member of the annular sleeve-valve member, which partially defines the combustion chamber of the tool and which is movable between OPENED and CLOSED positions, when the lock-out mechanism is disposed at its extended position, and guide rails are provided upon interior surface portions of the tool handle housing for guiding the movement of the lock-out mechanism as well as for bearing the forces which tend to move the annular sleeve-valve member to its combustion chamber OPENED position. In this manner, such forces do not bear upon the trigger mechanism whereby the tool operator does not become fatigued. In addition, a rotary member is rotatably mounted upon the lock-out mechanism so as to ensure the disengagement of the lock-out mechanism from the wear plate member of the annular sleeve-valve member, when it is desired to move the annular sleeve-valve member from its CLOSED position to its OPENED position, without such movement experiencing any jamming or freezing, despite the imposition of the noted forces upon the lock-out mechanism.

28 Claims, 3 Drawing Sheets

210
212
214
216
218
220
222
224
226
228
230
232
234
236
238
240
242
244
246
248
TU
TD
U
D

COMBUSTION CHAMBER LOCK-OUT MECHANISM

FIELD OF THE INVENTION

The present invention relates generally to combustion-powered fastener-driving tools, and more particularly to a new and improved lock-out mechanism which is operatively connected to the trigger mechanism of the combustion-powered fastener-driving tool, and which is also adapted for operative engagement with the annular sleeve member of the combustion-powered fastener-driving tool, wherein the annular sleeve member of the combustion-powered fastener-driving tool is integrally connected to the axially movable work-piece-contacting element of the combustion-powered fastener-driving tool so as to be axially movable with the axially movable workpiece-contacting element in order to effectively be disposed at combustion chamber OPEN and CLOSED positions, and wherein further, the new and improved lock-out mechanism is operatively engaged with the annular sleeve member of the combustion-powered fastener-driving tool so as to effectively prevent movement of the annular sleeve member of the combustion-powered fastener-driving tool from the combustion chamber CLOSED position to the combustion chamber OPEN position when the trigger mechanism of the combustion-powered fastener-driving tool is disposed in its actuated state, and yet, the new and improved lock-out mechanism is able to be readily disengaged from the annular sleeve member of the combustion-powered fastener-driving tool when the trigger mechanism of the combustion-powered fastener-driving tool is released from its actuated state.

BACKGROUND OF THE INVENTION

Combustion-powered fastener-driving tools are of course well known, and examples of such combustion-powered fastener-driving tools are disclosed within U.S. Pat. No. 6,145,724 which issued to Shkolnikov et al. on Nov. 14, 2000, U.S. Pat. No. 5,909,836 which issued to Shkolnikov et al. on Jun. 8, 1999, U.S. Pat. No. 5,197,646 which issued to Nikolich on Mar. 30, 1993, and U.S. Pat. No. 4,483,474 which issued to Nikolich on Nov. 20, 1984. In addition to the multitude of interactive operative components of such combustion-powered fastener driving tools which are obviously provided upon the tools in order to permit such combustion-powered fastener driving tools to operate in accordance with particular modes of operation desired or required by workmen or operators located at various job sites, the combustion-powered fastener-driving tools also usually incorporate a safety feature which effectively comprises a lock-out mechanism by means of which the trigger mechanism of the combustion-powered fastener-driving tool cannot be actuated if the workpiece-contacting element of the combustion-powered fastener-driving tool has not been previously disposed in contact with the substrate or workpiece into which the fasteners are to be driven, and in a similar manner, the annular sleeve member of the combustion-powered fastener-driving tool, which has been previously axially moved to a position at which the combustion chamber is effectively CLOSED so as to permit a combustion cycle to occur, cannot be moved to a position at which the combustion chamber is effectively OPENED as long as the tool trigger mechanism is still disposed in its actuated state. A lock-out mechanism of the foregoing type is disclosed, for example, within the aforenoted patent to Nikolich, U.S. Pat. No. 5,197,646.

More particularly, as disclosed within FIG. 1, which corresponds to FIG. 1 of the aforenoted patent to Nikolich, it is noted that the combustion-powered fastener-driving tool 10 briefly comprises a housing structure 12 which includes a principal portion 14 and a handle portion 16. The housing structure 12 also has incorporated therein a nail-feeding mechanism 20 which is adapted to successively feed a plurality of nails N into a nosepiece section 50 of the tool 10 at which a piston-driver blade assembly 40–42 can act thereon so as to successively drive the nails N into the underlying substrate or workpiece W. The piston 40 is movably disposed within a piston chamber 32 which is defined within a cylinder body 30, and a valve member-sleeve assembly 60–62 annularly surrounds the cylinder body 30. A combustion chamber 70 is effectively defined within an upper region of the combustion-powered fastener-driving tool 10 by means of the upper portion of the valve member-sleeve assembly 60–62, and a fan 72, powered by means of a motor 74, is disposed within the combustion chamber 70. The valve member-sleeve assembly 60–62 is axially movable with respect to the cylinder body 30 so as to be alternatively disposed at an upper combustion chamber CLOSED position and a lower combustion chamber OPENED position, and a workpiece contacting element 82 is movably mounted upon the nosepiece section 50. The workpiece contacting element 82 is operatively connected to the valve member-sleeve assembly 60–62 through means of a linkage 80 and a valve member-sleeve assembly actuating element 84, and accordingly, when the workpiece contacting element 82 is pressed into engagement with the workpiece W, the valve member-sleeve assembly 60–62 is moved from its aforenoted lower combustion chamber OPENED position to its upper combustion chamber CLOSED position.

In order to fire the combustion-powered fastener-driving tool 10, the same is provided with a trigger mechanism 120 which is normally biased to a lower or outward deactuated position, as viewed in FIG. 1, by means of a coil spring 122. A lock-out mechanism in the form of a pawl 130 has a first radially outer end portion 136 thereof pivotally mounted within the trigger mechanism 120, while a second radially inner end portion 131 thereof is adapted to be disposed within an aperture 140 of the valve member-sleeve assembly 60–62 when the valve member-sleeve assembly 60–62 has been moved to its upper combustion chamber CLOSED position, as a result of the engagement of the workpiece contacting element 82 with the workpiece W, and when the trigger mechanism 120 has also been moved to its upper or inward actuated position. Leg portions 134 of the pawl 130 are adapted to be disposed within grooved portions 132 formed within opposite halves of the housing 12 which form the handle portion 16 so as to permit the pawl 130 to freely undergo slidable and pivotal movements. A wear plate 142 is fixedly mounted upon an external side wall portion of the valve member-sleeve assembly 60–62, and accordingly, as long as the trigger mechanism 120 is maintained in its upper or inward actuated position, the valve member-sleeve assembly 60–62 will effectively be maintained in a LOCKED combustion-enabling position. When, however, the valve member-sleeve assembly 60–62 is disposed at its lowered combustion chamber OPENED position, as when the workpiece contacting element 82 has not been or is no longer properly engaged with the workpiece W, the inner end portion 131 of the pawl 130 will engage the wear plate 142 whereby the trigger mechanism 120 cannot in fact be moved from its lower or outward deactuated state to its upper or inward actuated state, thereby effectively preventing the undesirable firing of the combustion-powered fastener-driving tool 10.

While the aforenoted lock-out mechanism has performed quite satisfactorily, recent developments in connection with the design and interrelated arrangement of the various structural components of combustion-powered fastener-driving tools has resulted in the fabrication of high-energy tools which create or generate an enhanced level of force or power for driving the fasteners into the underlying substrate or workpiece. Under such operative conditions, the provision of a lock-out mechanism, of the type disclosed within the aforenoted patent to Nikolich, sometimes becomes somewhat difficult to manipulate or maintain at its combustion-chamber CLOSED position, during the firing or discharge of a fastener from the fastener-driving tool, in view of the fact that a substantially large portion of the operating force, required to manipulate or maintain the lock-out mechanism at such combustion-chamber CLOSED position, must simply be borne by means of the operator's finger which is operatively engaged with the trigger mechanism. Accordingly, in view of this ergonomically undesirable arrangement, the operator often suffers fatigue and discomfort. A solution to this problem has been sought by operatively reorienting the disposition of the lock-out mechanism, and by altering the support of the same during its movements attendant the actuation and deactuation of the tool trigger mechanism in order to effectively remove a substantial portion of the manipulation or maintenance forces, to be imparted to the lock-out mechanism pawl, from the trigger mechanism. Unfortunately, such design changes have sometimes resulted in the lock-out mechanism becoming jammed or frozen whereby, for example, the lock-out mechanism would not reliably move to its retracted or withdrawn position so as to, in turn, permit the valve member-sleeve assembly to move to its combustion chamber OPENED position in order to permit combustion product exhaust and air intake fluid flows to properly occur.

A need therefore exists in the art for a new and improved lock-out mechanism which is operatively connected to the trigger mechanism of the combustion-powered fastener-driving tool, and which is uniquely supported upon the handle portion of the tool housing, so as to be operatively engaged with the annular sleeve member of the combustion-powered fastener-driving tool without requiring an inordinate amount of force to be maintained upon the trigger mechanism of the tool in order to maintain the lock-out mechanism engaged with the annular sleeve member of the tool, whereby the annular sleeve member of the combustion-powered fastener-driving tool can be maintained at its combustion chamber CLOSED position and effectively prevented from undergoing movement from the combustion chamber CLOSED position to the combustion chamber OPEN position when the trigger mechanism of the combustion-powered fastener-driving tool is disposed in its actuated state, and yet, the new and improved lock-out mechanism is able to be readily disengaged from the annular sleeve member of the combustion-powered fastener-driving tool, when the trigger mechanism of the combustion-powered fastener-driving tool is released from its actuated state, so as not to undesirably prevent movement of the annular sleeve member from the combustion chamber CLOSED position to the combustion chamber OPENED position.

OBJECTS OF THE INVENTION

Accordingly, it is an object of the present invention to provide a new and improved lock-out mechanism for use in conjunction with a combustion-powered fastener-driving tool.

Another object of the present invention is to provide a new and improved lock-out mechanism for use in conjunction with a combustion-powered fastener-driving tool wherein the new and improved lock-out mechanism effectively overcomes the various operational drawbacks and disadvantages characteristic of conventional PRIOR ART lock-out mechanisms.

An additional object of the present invention is to provide a new and improved lock-out mechanism which is particularly useful in conjunction with high-energy combustion-powered fastener-driving tools which create or generate an enhanced level of force or power for driving the fasteners into an underlying substrate or workpiece.

A further object of the present invention is to provide a new and improved lock-out mechanism which is particularly useful in conjunction with high-energy combustion-powered fastener-driving tools, which create or generate an enhanced level of force or power for driving the fasteners into an underlying substrate or workpiece, wherein the new and improved lock-out mechanism is mounted and supported within the handle portion of the combustion-powered fastener-driving tool in such a manner as to bear a substantially large portion of the load forces required to maintain the lock-out mechanism at the combustion-chamber CLOSED position so as to in turn reduce or relieve the necessity of having the operator-manipulated trigger mechanism from bearing such load forces required to maintain the lock-out mechanism at the combustion-chamber CLOSED position.

A last object of the present invention is to provide a new and improved lock-out mechanism which is particularly useful in conjunction with high-energy combustion-powered fastener-driving tools, which create or generate an enhanced level of force or power for driving the fasteners into an underlying substrate or workpiece, wherein the new and improved lock-out mechanism is mounted and supported within the handle portion of the combustion-powered fastener-driving tool in such a manner as to bear a substantially large portion of the load forces required to maintain the annular sleeve member of the combustion-powered fastener-driving tool at the combustion-chamber CLOSED position so as to in turn reduce or relieve the necessity of having the operator-manipulated trigger mechanism from bearing such load forces required to maintain the annular sleeve member of the combustion-powered fastener-driving tool at the combustion-chamber CLOSED position, and wherein further, the new and improved lock-out mechanism is also able to be readily disengaged from the annular sleeve member of the combustion-powered fastener-driving tool, when the trigger mechanism of the combustion-powered fastener-driving tool is released from its actuated state, so as not to undesirably prevent movement of the annular sleeve member from the combustion chamber CLOSED position to the combustion chamber OPENED position.

SUMMARY OF THE INVENTION

The foregoing and other objectives are achieved in accordance with the teachings and principles of the present invention through the provision of a new and improved lock-out mechanism, for use in conjunction with a combustion-powered fastener-driving tool, which comprises a lock-out bar wherein a first end portion of the lock-out bar is pivotally connected to the trigger mechanism of the combustion-powered fastener-driving tool, while the second opposite end portion of the lock-out bar comprises a substantially C-shaped loop section which is oriented at an angle of substantially 90° with respect to the axial extent of the annular sleeve member of the combustion-powered fastener-driving tool. In conjunction with the aforenoted 90° orientation of the C-shaped loop section with respect to the axial extent of the annular sleeve member of the combustion-powered fastener-driving tool, a distal end portion of the C-shaped loop section is slidably supported between a pair of guide rails which are formed upon internal surface regions of each housing half forming the handle portion of the combustion-powered fastener-driving tool. In this manner, the lock-out bar and the guide rails of the handle housing halves bear substantially the entire portion of the load forces necessary to maintain the annular sleeve member of the combustion-powered fastener-driving tool at the combustion chamber CLOSED position so as to, in turn, effectively obviate the need for the operator-manipulated trigger mechanism from bearing such load forces.

In addition, in order to readily facilitate the disengagement of the lock-out bar from its engaged position with the annular sleeve member of the combustion-powered fastener-driving tool, so as to permit the annular sleeve member of the combustion-powered fastener-driving tool to be moved from the combustion chamber CLOSED position to the combustion chamber OPENED position, the substantially C-shaped loop section of the lock-out bar is provided with a member which is rotatably mounted thereon and which is also rotatably engaged with a wear plate portion of the annular sleeve member. Accordingly, when the trigger mechanism of the combustion-powered fastener-driving tool is no longer maintained at its actuated position, the rotatable member of the lock-out bar readily facilitates the slidable disengagement of the lock-out bar with respect to the wear plate portion of the annular sleeve member so as to effectively permit the annular sleeve member to be released or moved from the combustion chamber CLOSED position to the combustion chamber OPENED position.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
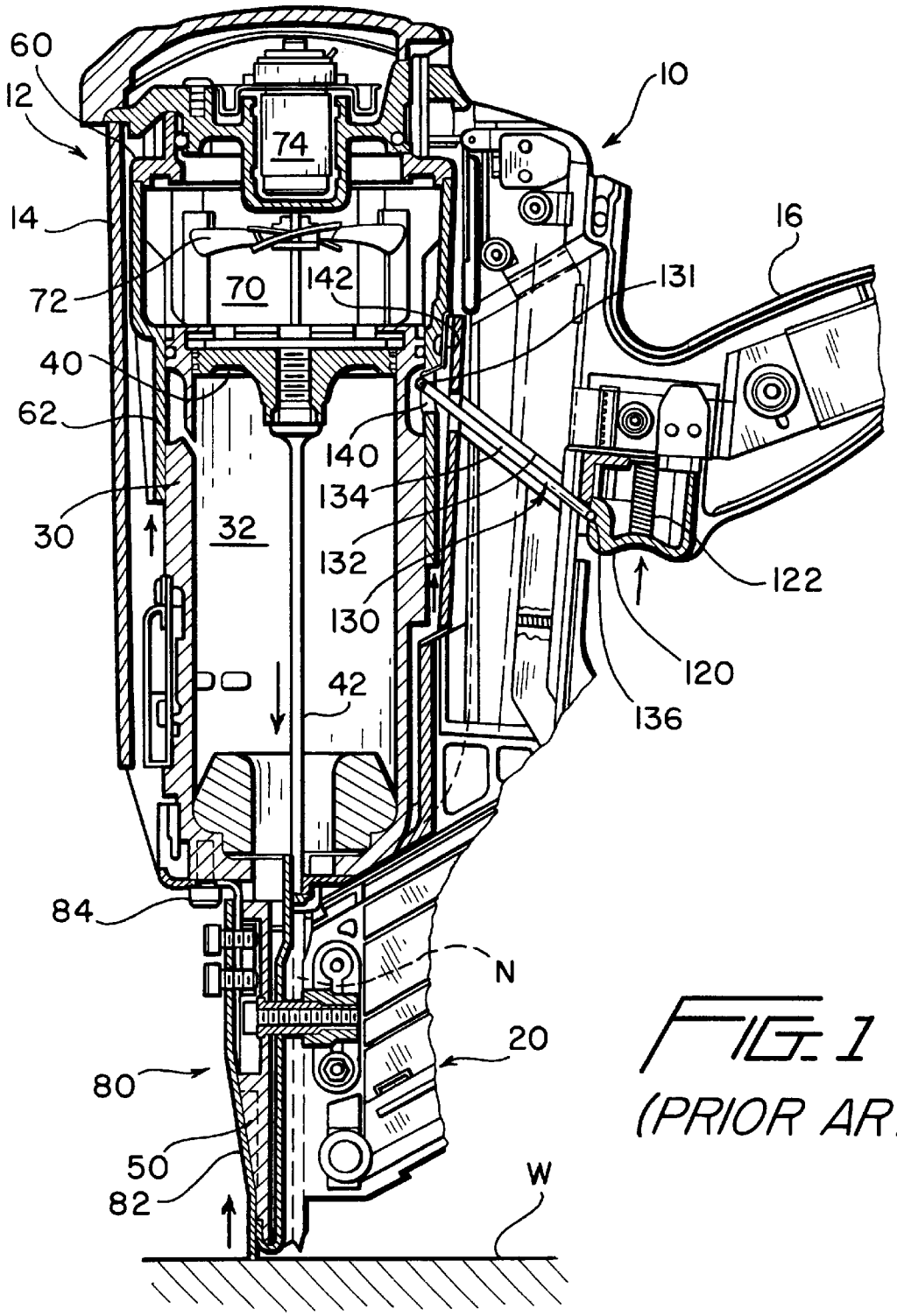
FIG. 1 (PRIOR ART)
FIG. 1 is a vertical cross-sectional view of a conventional PRIOR ART combustion-powered fastener-driving tool which has a conventional, PRIOR ART combustion-chamber lock-out mechanism incorporated therein.
Figure 2:
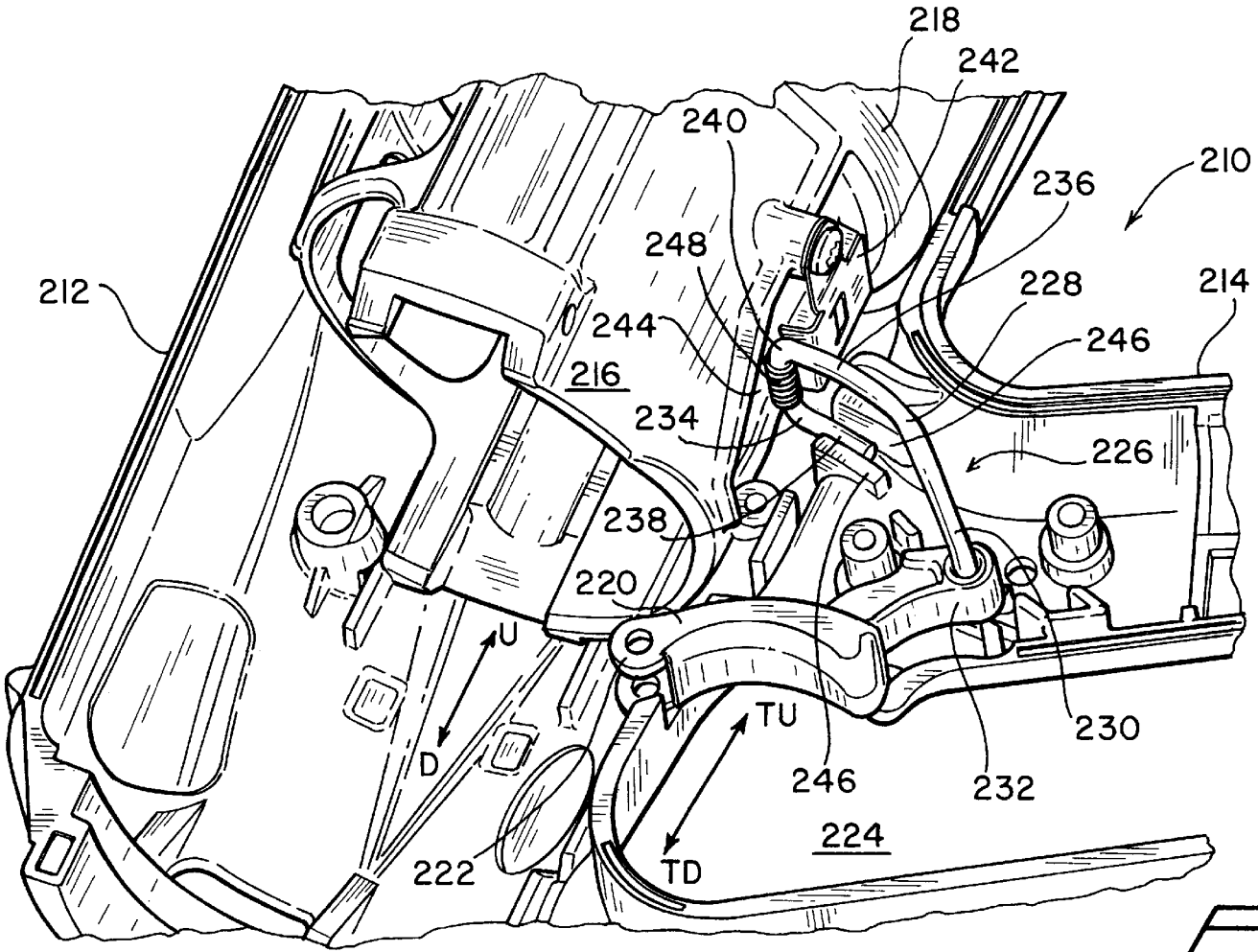
FIGS. 2 and 3 are partial perspective views, of relatively different detail size, showing one of the housing halves of a combustion-powered fastener-driving tool, wherein a new and improved lock-out mechanism, constructed in accordance with the principles and teachings of the present invention, is disclosed as being operatively connected to the combustion-powered fastener-driving tool trigger mechanism and is also illustrated at its engaged position with respect to the wear plate portion of the annular sleeve member so as to maintain the annular sleeve member at its combustion chamber CLOSED position.
Figure 3:
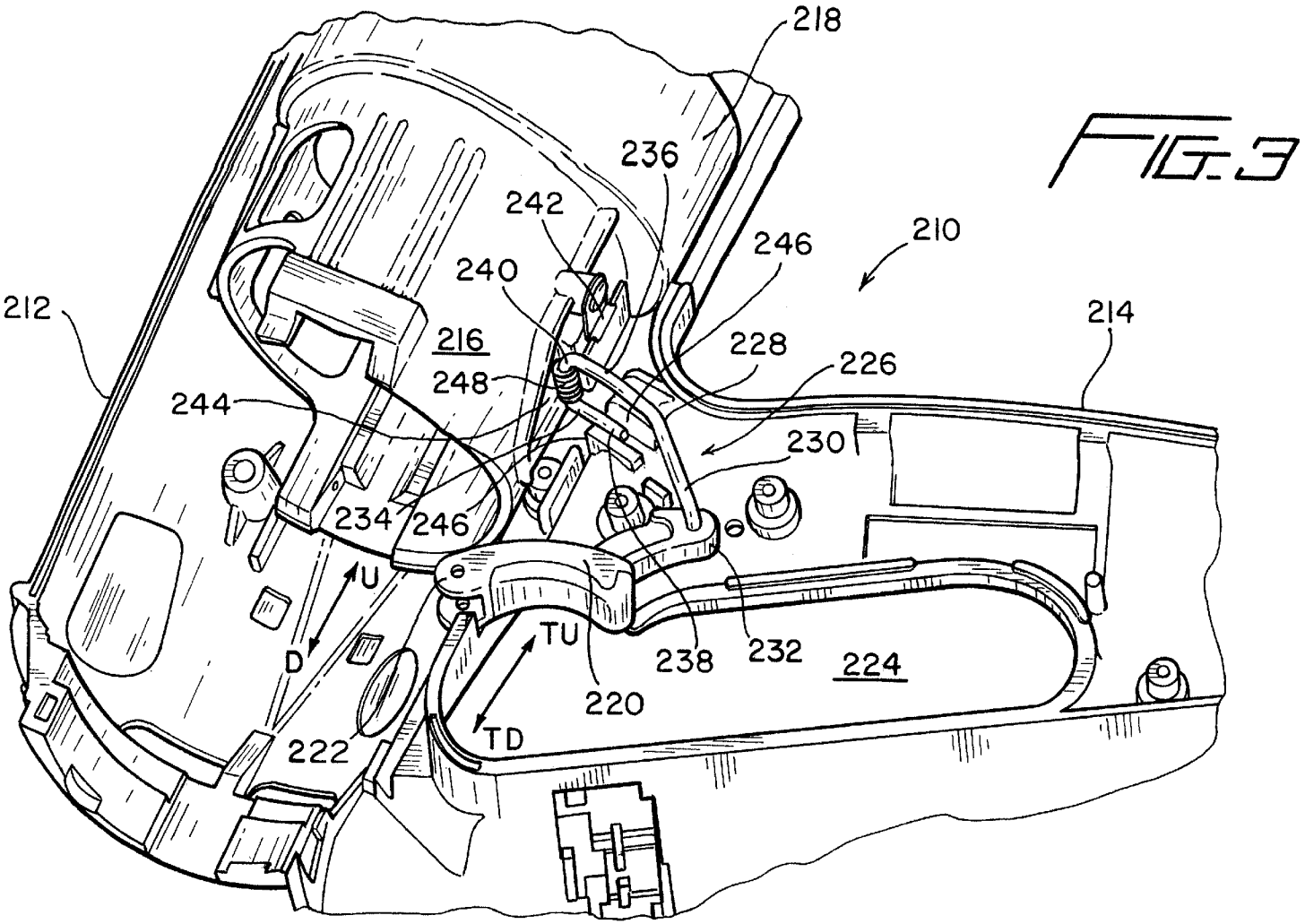

Referring now to the drawings, and more particularly to FIGS. 2 and 3 thereof, a new and improved combustion-powered fastener-driving tool, constructed in accordance with the principles and teachings of the present invention, is disclosed and is generally indicated by the reference character 210. For the purposes of the description of the new and improved combustion-powered fastener-driving tool 210 of the present invention, it is to be noted that the use of appropriate terminology, such as, for example, "vertical", "horizontal", "upper", "lower", and the like, are to be considered from the perspective of the normal use of the combustion-powered fastener-driving tool 110 in connection with the driving of a fastener into an underlying workpiece or substrate W as been previously described, for example, in connection with the combustion-powered fastener-driving tool 10 illustrated within FIG. 1. Accordingly, it can therefore be appreciated that in a manner similar to the conventional PRIOR ART combustion-powered fastener-driving tool 10 as disclosed within FIG. 1, the combustion-powered fastener-driving tool 210 of the present invention is seen to comprise, in part, a main or primary housing section 212 and a handle housing section 214 integrally connected to the main or primary housing section 212. It is of course to be appreciated that when the combustion-powered fastener-driving tool 210 is assembled, the main or primary and handle housing sections 212,214 of the combustion-powered fastener-driving tool 210 will actually be formed as a result of the mating together of oppositely disposed main or primary housing and handle housing half sections, only one of such main or primary and handle housing half sections actually being illustrated for clarity purposes within FIGS. 2 and 3.

An annular sleeve-valve member 216, within the upper part of which there is partially defined the tool combustion chamber 218, is adapted to be operatively connected to a workpiece-contacting element, not shown, and the annular sleeve-valve member 216 is therefore adapted to be axially movable upwardly and downwardly, as denoted by means of the double arrowhead U-D, with respect to the main or primary housing section 212 of the combustion-powered fastener-driving tool 210 in response to the contact engagement or disengagement of the workpiece-contacting element, not shown, with an underlying workpiece or substrate. In this manner, the annular sleeve-valve member 216 will be respectively disposed at a combustion chamber CLOSED position and a combustion-chamber OPENED position. A trigger mechanism 220 is pivotally mounted, at a first end portion 222 thereof, at the juncture of the main or primary and handle housing sections 212,214 of the combustion-powered fastener-driving tool 210, and it is seen that the handle housing section 214 is provided with an elongated aperture 224 through which the fingers of the tool operator may be inserted so as to enable the tool operator to properly and comfortably grasp the combustion-powered fastener-driving tool 210, and in addition, to enable, for example, the index finger of the tool operator to operate the trigger mechanism 220.

In accordance with the unique and novel developmental principles and teachings of the present invention, it is also seen from FIGS. 2 and 3 that a new and improved lock-out mechanism, generally indicated by the reference character 226, has been provided upon, and incorporated within, the combustion-powered fastener-driving tool 210 of the present invention. More particularly, the new and improved lock-out mechanism 226 is seen to comprise a lock-out bar 228 which comprises a post member 230 which extends substantially horizontally between the oppositely disposed half sections defining the handle housing section 214. A first end portion of the post member 230 is operatively engaged with a second end portion 232 of the trigger mechanism 220, and it is appreciated that the post member 230 is located at a relatively radially outward position as considered with respect to the vertical axis of the primary or main housing section 212 of the combustion-powered fastener-driving tool 210. The second opposite end portion of the post member 230 is integrally connected to a substantially C-shaped loop portion 234 which is disposed within a substantially horizontal plane and which extends radially inwardly from the post member 230, as again considered with respect to the vertical axis of the primary or main housing section 212 of the combustion-powered fastener-driving tool 210. The substantially C-shaped loop portion 234 of the lock-out mechanism 226 is seen to comprise a first relatively long leg member 236 which is integrally connected to the post member 230, a second relatively short leg member 238, and a bight section 240 which integrally connects the first relatively long leg member 236 and the second relatively short leg member 238 together.

With reference still being made to FIGS. 2 and 3, a combustion chamber wear plate 242 is fixedly mounted upon a side wall portion of the annular sleeve-valve member 216, and a radially recessed region 244 is also defined within the side wall portion of the annular sleeve-valve member 216 at a position disposed immediately beneath the combustion chamber wear plate 242. It can therefore be readily appreciated that, as a result of the operative interconnection defined between the lock-out mechanism 226 and the trigger mechanism 220, when the trigger mechanism 220 moves downwardly, as indicated by means of the arrow TD, such as, for example, when the trigger mechanism 220 is not being actuated to its operative firing position by means of the tool operator, the lock-out mechanism 226 will be moved to a retracted position at which the bight portion 240 of the lock-out mechanism 226 will have been moved substantially radially outwardly. In this manner, the bight portion 240 of the lock-out mechanism 226 will be effectively withdrawn from its position as illustrated within FIGS. 2 and 3, at which the bight portion 240 of the lock-out mechanism 226 is lockingly engaged with the undersurface portion of the combustion chamber wear plate 242, so as to permit the annular sleeve-valve member 216 to be moved downwardly, in accordance with the arrow D, in order to achieve its combustion-chamber OPENED position. Conversely, when the trigger mechanism 220 is moved upwardly, as indicated by means of the arrow TU, such as, for example, when the trigger mechanism 220 is actuated to its operative firing position by means of the tool operator, the lock-out mechanism 226 will be moved to an extended position at which the bight portion 240 of the lock-out mechanism 226 will have been moved substantially radially inwardly. In this manner, the bight portion 240 of the lock-out mechanism 226 will be disposed at its position within the recessed portion 244 of the annular sleeve-valve member 216, as illustrated within FIGS. 2 and 3, at which the bight portion 240 of the lock-out mechanism 226 is lockingly engaged with the undersurface portion of the combustion chamber wear plate 242 so as to maintain the annular sleeve-valve member 216 at its combustion chamber CLOSED position and thereby positively prevent the annular sleeve-valve member 216 from undesirably moving downwardly to its combustion-chamber OPENED position.

In accordance with further principles and teachings of the present invention, it will be additionally noted that, in order to properly guide the substantially radially inward and radially outward movements of the lock-out mechanism 226, and particularly the substantially radially inward and radially outward movements of the bight portion 240 of the lock-out mechanism 226, in accordance with the actuated and non-actuated states of the tool trigger mechanism 220, a pair of substantially vertically spaced, radially oriented guide rails 246,246 are fixedly provided upon an oppositely disposed or oppositely facing internal surface portion of each one of the handle housing half sections 214. More particularly, as can be readily appreciated from FIG. 2 and 3, the illustrated vertically spaced guide rails 246,246 serve to positionally accommodate therebetween the second relatively short leg member 238 of the lock-out mechanism 226, while similarly positioned guide rails, not illustrated, disposed upon the other mating handle housing half section, also not illustrated, serve to positionally accommodate the first relatively long leg member 236 of the lock-out mechanism 226. This structural interrelationship defined between the first and second relatively long and relatively short leg members 236,238 of the lock-out bar 228, and the guide rails 246,246, is a critically important feature of the present invention lock-out mechanism 226.

More particularly, it is to be especially appreciated that in view of the fact that the guide rails 246,246 are oriented substantially radially with respect to the longitudinal axis of the main or primary housing section 212, or at an angle of approximately 90° with respect to the directional movement of the annular sleeve-valve member 216, and in view of the additional fact that the first and second relatively long and relatively short leg members 236,238 of the lock-out bar 228 are supported by means of the guide rails 246,246 in such a manner that the bight portion 240 of the lock-out bar 228 extends, in effect, outwardly therefrom in a cantilevered manner so as to be able to engage the undersurface portion of the combsution chamber wear plate 242 when the trigger mechanism 220 is moved upwardly to its actuated state or position, forces tending to move the annular sleeve-valve member 216 downwardly toward its combustion chamber OPENED position are no longer borne by means of the trigger mechanism 220 and the tool operator's fingers whereby the operator does not suffer fatigue and shock forces. To the contrary, such forces are borne by means of the lock-out bar guide rails 246,246. In addition, it may be appreciated further that due to such downward forces acting upon the cantilevered bight portion 240 of the lock-out bar 228, as well as in view of the forced engagement of the first and second relatively long and relatively short leg members 236, 238 of the lock-out bar 228 with the guide rails 246,246, then when the trigger mechanism 220 is permitted to move downwardly back toward its non-actuated or released state, as indicated by means of the arrow TD and as a result of the tool operator having removed the actuating force from the trigger mechanism 220, the bight portion 240 of the lock-out bar 228 may not always readily release or disengage from its recessed disposition beneath the combustion chamber wear plate 242, and in fact may sometimes effectively become jammed or frozen with respect to the combustion chamber wear plate 242.

Accordingly, although it is desired at this point in time during the fastener-driving operation cycle to move the annular sleeve-valve member 216 to its combustion-chamber OP-ENED position, such movement of the annular sleeve-valve member 216 may not always be able to be achieved. Consequently, in accordance with an additional critically important structural feature of the present invention, a rotary member 248 is freely rotatably mounted upon the bight portion 240 of the lock-out bar 228. It is noted that the rotary member 248 may comprise various rotary structures, such as, for example, a simple coil spring member, a roller bearing, a rotary sleeve member, and the like. It is to be appreciated, however, that the critically important feature or structural characteristic of the rotary member 248 is that it is freely rotatable upon the bight portion 240 of the lock-out bar 228 such that when the lock-out bar 228 is desired to move radially outwardly as a result of the lock-out mechanism 226 being retracted away from the annular sleeve-valve member 216 so as to be operationally disengaged from the combustion chamber wear plate 242, the freely rotatable mounting of the rotary member 248 upon the bight portion 240 of the lock-out bar 228 permits the rotary member 248 to effectively roll along the undersurface portion of the combustion chamber wear plate 242. In this manner, no jamming or freezing of the bight portion 240 of the lock-out mechanism 226 will occur with respect to the combustion chamber wear plate 242, and accordingly, the desired disengagement of the lock-out mechanism 226 from the combustion chamber wear plate 242 can be readily achieved so as to permit the annular sleeve-valve member 216 to move downwardly to its combustion chamber OPENED position upon conclusion of a tool firing cycle for discharging a fastener out from the tool 210 and into an underlying workpiece or substrate.

It is to be further appreciated that in accordance with the provision of the new and improved lock-out mechanism 226 of the present invention, and in a manner similar to the conventional PRIOR ART lock-out mechanism of the aforenoted Nikolich patent, should it be attempted to move the trigger mechanism 220 of the combustion-powered fastener-driving tool 210 to its upper actuated tool-firing position prior to the engagement of the work-piece-contacting element, not shown, of the combustion-powered fastener-driving tool 210 with the underlying substrate or workpiece, the bight portion 240 of the lock-out mechanism 226 will engage a side wall portion of the combustion chamber wear plate 242. In this manner, radially inward movement of the lock-out bar 228 will be effectively prevented so as to in turn effectively prevent the trigger mechanism 220 from in fact being moved to its upper actuated, tool firing position.

Thus, it may be seen that in accordance with the teachings and principles of the present invention, there has been provided a new and improved combustion chamber lock-out mechanism for use in conjunction with a combustion-powered fastener-driving tool wherein a lock-out bar member of the lock-out mechanism operatively engages a combustion chamber wear plate member during the combustion chamber CLOSED position in such a manner that forces, tending to move the annular sleeve-valve member of the combustion-powered fastener-driving tool toward its combustion chamber OPENED position, are borne by guide rails with which the lock-out bar member is operatively engaged. In this manner, such forces are not transmitted to or borne by the tool operator's fingers, thereby eliminating stress and fatigue to the operator. In addition, the lock-out bar has a rotary member freely rotatable thereon in order to ensure that the lock-out bar will in fact readily disengage from the combustion chamber wear plate when the trigger mechanism is released and it is desired to permit the annular sleeve-valve member to move to its combustion chamber OPENED position. Still further, the lock-out mechanism of the present invention will also engage a side wall portion of the combustion chamber wear plate so as to effectively prevent the trigger mechanism from moving to its actuated, tool-firing position if the workpiece-contacting element of the combustion-powered fastener-driving tool has not been previously moved into forced contact with an underlying workpiece or substrate.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by letters patent of the United States of America, is:

1. A lock-out mechanism, for use in conjunction with a combustion-powered fastener driving tool having a trigger mechanism for initiating a tool firing operation in order to discharge a fastener from the combustion-powered fastener-driving tool, and an annular sleeve-valve member which partially defines a combustion chamber within the combustion-powered fastener-driving tool and which is movable upon the combustion-powered, fastener-driving tool between a combustion chamber CLOSED position and a combustion chamber OPENED position, for controlling the movement of the annular sleeve valve member between the combustion chamber CLOSED position and the combustion chamber OPENED position, comprising:

a lock-out bar having a first end portion for operative engagement with the trigger mechanism of the combustion-powered fastener-driving tool so as to be movable between a first extended position, at which a second end portion of said lock-out bar can operatively engage the annular sleeve-valve member of the combustion-powered fastener-driving tool so as to maintain the annular sleeve-valve member at its combustion chamber CLOSED position, when the trigger mechanism of the combustion-powered fastener-driving tool is moved to its actuated position, and a second retracted position, at which said second end portion of said lock-out bar is operatively disengaged from the annular sleeve-valve member of the combustion-powered fastener-driving tool so as to permit the annular sleeve-valve member to move to its combustion chamber OPENED position, when the trigger mechanism of the combustion-powered fastener-driving tool is moved to its non-actuated position; and guide rail means disposed substantially perpendicular to the directional movement of the annular sleeve-valve member for guiding the movement of said lock-out bar between said first extended and second retracted positions and for bearing the forces tending to move the annular sleeve-valve member from its combustion chamber CLOSED position to its combustion chamber OPENED position, while the annular sleeve valve member is disposed at its combustion chamber CLOSED position, so as to prevent the transmission of such forces to the tool trigger mechanism and thereby effectively prevent operator fatigue.

2. The lock-out mechanism as set forth in claim 1, wherein:

said guide rail means comprises a pair of spaced guide rails, adapted to be fixedly mounted upon the combustion-powered fastener-driving tool, and between which a portion of said lock-out bar is movably disposed.

3. The lock-out mechanism as set forth in claim 1, wherein:

said guide rail means comprises two pairs of spaced guide rails, adapted to be fixedly mounted upon oppositely disposed interior surface portions of the combustion-powered fastener-driving tool, and between which portions of said lock-out bar are movably disposed.

4. The lock-out mechanism as set forth in claim 3, wherein said lock-out bar comprises:

a post portion operatively connected to the trigger mechanism of the combustion-powered fastener-driving tool; and a substantially C-shaped loop portion integrally connected to said post portion and comprising a first relatively short leg member for guided disposition between a first one of said two pairs of spaced guide rails, and a second relatively long leg member for guided disposition between a second one of said two pairs of spaced guide rails.

5. The lock-out mechanism as set forth in claim 4, further comprising:

a bight portion defined upon said lock-out bar and integrally interconnecting said first relatively short and said second relatively long leg members together; and a rotary member rotatably mounted upon said bight portion of said lock-out bar for rolling along the annular sleeve-valve member when said lock-out bar is being moved from said first extended position to said second retracted position so as to facilitate the disengagement of said lock-out bar from the annular sleeve-valve member despite the forces of the annular sleeve-valve member bearing upon said lock-out bar.

6. The lock-out mechanism as set forth in claim 5, wherein:

said rotary member comprises a member selected from a group comprising a coil spring, a roller bearing, and a rotary sleeve member.

7. A lock-out mechanism, for use in conjunction with a combustion-powered fastener driving tool having a trigger mechanism for initiating a tool firing operation in order to discharge a fastener from the combustion-powered fastener-driving tool, and an annular sleeve-valve member which partially defines a combustion chamber within the combustion-powered fastener-driving tool and which is movable upon the combustion-powered, fastener-driving tool between a combustion chamber CLOSED position and a combustion chamber OPENED position, for controlling the movement of the annular sleeve valve member between the combustion chamber CLOSED position and the combustion chamber OPENED position, comprising:

a lock-out bar having a first end portion for operative engagement with the trigger mechanism of the combustion-powered fastener-driving tool so as to be movable between a first extended position, at which a second end portion of said lock-out bar can operatively engage the annular sleeve-valve member of the combustion-powered fastener-driving tool so as to maintain the annular sleeve-valve member at its combustion chamber CLOSED position, when the trigger mechanism of the combustion-powered fastener-driving tool is moved to its actuated position, and a second retracted position, at which said second end portion of said lock-out bar is operatively disengaged from the annular sleeve-valve member of the combustion-powered fastener-driving tool so as to permit the annular sleeve-valve member to move to its combustion chamber OPENED position, when the trigger mechanism of the combustion-powered fastener-driving tool is moved to its non-actuated position; and a rotary member rotatably mounted upon said lock-out bar for rolling along the annular sleeve-valve member when said lock-out bar is being moved from said first extended position, at which said lock-out bar is engaged with the annular sleeve-valve member so as to maintain the annular sleeve-valve member at its combustion chamber CLOSED position, to said second retracted position so as to facilitate the disengagement of said lock-out bar from the annular sleeve-valve member despite the presence of forces tending to prevent the disengagement of said lock-out bar from the annular sleeve-valve member.

8. The lock-out mechanism as set forth in claim 7, wherein:

said rotary member comprises a member selected from a group comprising a coil spring, a roller bearing, and a rotary sleeve member.

9. The lock-out mechanism as set forth in claim 7, further comprising:

guide rail means disposed substantially perpendicular to the directional movement of the annular sleeve-valve member for guiding the movement of said lock-out bar between said first extended and second retracted positions and for bearing the forces tending to move the annular sleeve-valve member from its combustion chamber CLOSED position to its combustion chamber OPENED position, while the annular sleeve valve member is disposed at its combustion chamber CLOSED position, so as to prevent the transmission of such forces to the tool trigger mechanism and thereby effectively preventing operator fatigue.

10. The lock-out mechanism as set forth in claim 9, wherein:

said guide rail means comprises a pair of spaced guide rails, adapted to be fixedly mounted upon the combustion-powered fastener-driving tool, and between which a portion of said lock-out bar is movably disposed.

11. The lock-out mechanism as set forth in claim 9, wherein:

said guide rail means comprises two pairs of spaced guide rails, adapted to be fixedly mounted upon oppositely disposed interior surface portions of the combustion-powered fastener-driving tool, and between which portions of said lock-out bar are movably disposed.

12. The lock-out mechanism as set forth in claim 11, wherein said lock-out bar comprises:

a post portion operatively connected to the trigger mechanism of the combustion-powered fastener-driving tool; and a substantially C-shaped loop portion integrally connected to said post portion and comprising a first relatively short leg member for guided disposition between a first one of said two pairs of spaced guide rails, and a second relatively long leg member for guided disposition between a second one of said two pairs of spaced guide rails.

13. The lock-out mechanism as set forth in claim 12, wherein:

a bight portion is defined upon said lock-out bar for integrally interconnecting said first relatively short and said second relatively long leg members together; and said rotary member is rotatably mounted upon said bight portion of said lock-out bar.

14. A combustion-powered fastener driving tool, comprising:

a trigger mechanism movably mounted upon said combustion-powered fastener-driving tool between a first actuated position for initiating a tool firing operation in order to discharge a fastener from said combustion-powered fastener-driving tool, and a second non-actuated position for terminating a tool firing operation;

an annular sleeve-valve member partially defining a combustion chamber within said combustion-powered fastener driving tool and movable upon said combustion-powered, fastener-driving tool between a combustion chamber CLOSED position and a combustion chamber OPENED position;

a lock-out mechanism having a first end portion operatively engaged with said trigger mechanism of said combustion-powered fastener-driving tool so as to be movable between a first extended position, at which a second end portion of said lock-out mechanism operatively engages said annular sleeve-valve member of said combustion-powered fastener-driving tool so as to maintain said annular sleeve-valve member at said combustion chamber CLOSED position, when said trigger mechanism of said combustion-powered fastener-driving tool is moved to said first actuated position, and a second retracted position, at which said second end portion of said lock-out mechanism is operatively disengaged from said annular sleeve-valve member of said combustion-powered fastener-driving tool so as to permit said annular sleeve-valve member to move to said combustion chamber OPENED position, when said trigger mechanism of said combustion-powered fastener-driving tool is moved to said second non-actuated position; and guide rail means disposed substantially perpendicular to the directional movement of said annular sleeve-valve member for guiding said movement of said lock-out mechanism between said first extended and second retracted positions and for bearing the forces tending to move said annular sleeve-valve member from said combustion chamber CLOSED position to said combustion chamber OPENED position, while said annular sleeve valve member is disposed at said combustion chamber CLOSED position, so as to prevent the transmission of such forces to said tool trigger mechanism and thereby effectively prevent operator fatigue.

15. The combustion-powered fastener driving tool as set forth in claim 14, wherein:

said combustion-powered fastener-driving tool comprises a handle housing upon which said trigger mechanism is movably mounted;

said guide rail means comprises a pair of spaced guide rails, fixedly mounted upon said combustion-powered fastener-driving tool handle housing, and between which a portion of said lock-out mechanism is movably disposed.

16. The combustion-powered fastener-driving tool as set forth in claim 14, wherein:

said combustion-powered fastener-driving tool comprises a handle housing comprising handle housing half sections upon one of which said trigger mechanism is movably mounted; and said guide rail means comprises two pairs of spaced guide rails, respectively fixedly mounted upon oppositely disposed interior surface portions of said handle housing half sections of said combustion-powered fastener-driving tool, and between which portions of said lock-out mechanism are movably disposed.

17. The combustion-powered fastener-driving tool as set forth in claim 16, wherein said lock-out mechanism comprises:

a post portion operatively connected to said trigger mechanism of said combustion-powered fastener-driving tool; and a substantially C-shaped loop portion integrally connected to said post portion and comprising a first relatively short leg member for guided disposition between a first one of said two pairs of spaced guide rails, and a second relatively long leg member for guided disposition between a second one of said two pairs of spaced guide rails.

18. The combustion-powered fastener-driving tool as set forth in claim 17, wherein:

a bight portion is defined upon said lock-out mechanism and integrally interconnects said first relatively short and said second relatively long leg members together; and a rotary member is rotatably mounted upon said bight portion of said lock-out mechanism for rolling along said annular sleeve-valve member when said lock-out mechanism is being moved from said first extended position to said second retracted position so as to facilitate the disengagement of said lock-out mechanism from said annular sleeve-valve member despite the forces of said annular sleeve-valve member bearing upon said lock-out mechanism.

19. The combustion-powered fastener-driving tool as set forth in claim 18, wherein:

said rotary member comprises a member selected from a group comprising a coil spring, a roller bearing, and a rotary sleeve member.

20. The combustion-powered fastener-driving tool as set forth in claim 14, wherein:

said annular sleeve-valve member comprises a combustion chamber wear plate; and said second end portion of said lock-out mechanism operatively engages said combustion chamber wear plate of said annular sleeve-valve member so as to maintain said annular sleeve-valve member at said combustion chamber CLOSED position.

21. A combustion-powered fastener driving tool, comprising:

a trigger mechanism movably mounted upon said combustion-powered fastener-driving tool between a first actuated position for initiating a tool firing operation in order to discharge a fastener from said combustion-powered fastener-driving tool, and a second non-actuated position for terminating a tool firing operation;

an annular sleeve-valve member partially defining a combustion chamber within said combustion-powered fastener driving tool and movable upon said combustion-powered, fastener-driving tool between a combustion chamber CLOSED position and a combustion chamber OPENED position;

a lock-out mechanism having a first end portion operatively engaged with said trigger mechanism of said combustion-powered fastener-driving tool so as to be movable between a first extended position, at which a second end portion of said lock-out mechanism operatively engages said annular sleeve-valve member of said combustion-powered fastener-driving tool so as to maintain said annular sleeve-valve member at said combustion chamber CLOSED position, when said trigger mechanism of said combustion-powered fastener-driving tool is moved to said first actuated position, and a second retracted position, at which said second end portion of said lock-out mechanism is operatively disengaged from said annular sleeve-valve member of said combustion-powered fastener-driving tool so as to permit said annular sleeve-valve member to move to said combustion chamber OPENED position, when said trigger mechanism of said combustion-powered fastener-driving tool is moved to said second non-actuated position; and a rotary member rotatably mounted upon said lock-out mechanism for rolling along said annular sleeve-valve member when said lock-out mechanism is being moved from said first extended position, at which said lock-out mechanism is engaged with said annular sleeve-valve member so as to maintain said annular sleeve-valve member at said combustion chamber CLOSED position, to said second retracted position so as to facilitate said disengagement of said lock-out mechanism from said annular sleeve-valve member despite the presence of forces tending to prevent said disengagement of said lock-out mechanism from said annular sleeve-valve member.

22. The combustion-powered fastener driving tool as set forth in claim 21, wherein:

said rotary member comprises a member selected from a group comprising a coil spring, a roller bearing, and a rotary sleeve member.

23. The combustion-powered fastener driving tool as set forth in claim 21, further comprising:

guide rail means disposed substantially perpendicular to the directional movement of said annular sleeve-valve member for guiding said movement of said lock-out mechanism between said first extended and second retracted positions and for bearing the forces tending to move said annular sleeve-valve member from said combustion chamber CLOSED position to said combustion chamber OPENED position, while said annular sleeve valve member is disposed at said combustion chamber CLOSED position, so as to prevent the transmission of such forces to said tool trigger mechanism and thereby effectively prevent operator fatigue.

24. The combustion-powered fastener driving tool as set forth in claim 23, wherein:

said combustion-powered fastener-driving tool comprises a handle housing upon which said trigger mechanism is movably mounted; and said guide rail means comprises a pair of spaced guide rails, fixedly mounted upon said combustion-powered fastener-driving tool handle housing, and between which a portion of said lock-out mechanism is movably disposed.

25. The combustion-powered fastener driving tool as set forth in claim 23, wherein:

said combustion-powered fastener-driving tool comprises a handle housing comprising handle housing half sections upon one of which said trigger mechanism is movably mounted; and said guide rail means comprises two pairs of spaced guide rails, respectively fixedly mounted upon oppositely disposed interior surface portions of said handle housing half sections of said combustion-powered fastener-driving tool, and between which portions of said lock-out mechanism are movably disposed.

26. The combustion-powered fastener-driving tool as set forth in claim 25, wherein said lock-out mechanism comprises:

a post portion operatively connected to said trigger mechanism of said combustion-powered fastener-driving tool; and a substantially C-shaped loop portion integrally connected to said post portion and comprising a first relatively short leg member for guided disposition between a first one of said two pairs of spaced guide rails, and a second relatively long leg member for guided disposition between a second one of said two pairs of spaced guide rails.

27. The combustion-powered fastener-driving tool as set forth in claim 26, wherein:

a bight portion is defined upon said lock-out mechanism and integrally interconnects said first relatively short and said second relatively long leg members together; and said rotary member is rotatably mounted upon said bight portion of said lock-out mechanism.

28. The combustion-powered fastener-driving tool as set forth in claim 21, wherein:

said annular sleeve-valve member comprises a combustion chamber wear plate; and said second end portion of said lock-out mechanism operatively engages said combustion chamber wear plate of said annular sleeve-valve member so as to maintain said annular sleeve-valve member at said combustion chamber CLOSED position.

* * * * *